United States Patent [19]

Marchetti

[11] 4,060,442

[45] Nov. 29, 1977

[54] MACHINE FOR SEALING PARALLELEPIPEDAL BOXES HAVING A VARIABLE HEIGHT

[76] Inventor: Augusto Marchetti, Piazza Sicilia, 7 Milan, Italy

[21] Appl. No.: 738,511

[22] Filed: Nov. 3, 1976

[30] Foreign Application Priority Data

Nov. 28, 1975 Italy ..... 29840/75

[51] Int. Cl.[2] ..... G05G 15/00

[52] U.S. Cl. ..... 156/358; 156/360; 156/468

[58] Field of Search ..... 156/350, 358, 360, 522, 156/468; 53/75, 76, 137; 137/513.5, 596.2; 91/446–448, 198, 468, 469

[56] References Cited

U.S. PATENT DOCUMENTS

| | | | |
|---|---|---|---|
| 3,075,356 | 1/1963 | Fiala et al. | 91/446 X |
| 3,309,852 | 3/1967 | Allen | 137/596.2 X |
| 3,419,038 | 12/1968 | Andresen | 137/513.5 X |
| 3,466,843 | 9/1969 | Mumder | 156/522 X |
| 3,505,774 | 4/1970 | Gidge | 53/75 X |

FOREIGN PATENT DOCUMENTS 946,715 5/1973 Italy.

*Primary Examiner*—David A. Simmons
*Attorney, Agent, or Firm*—Karl W. Flocks

[57] ABSTRACT

A box-sealing machine in which prismatic boxes to be sealed by a sticking tape are caused to advance on a conveying horizontal path to arrive beneath a sealing head which applies a sticker to the two folded down top flaps of the box to seal the latter, the sealing head dropping onto the box wall to effect sealing and being lifted as sealing is completed, to repeat the operation for each box being presented to the sealing head in succession, the improvement consisting in that a cutoff valve is provided in the fluid-operated circuit which lifts and depresses the sealing head so as to stop the descending movement of the sealing head on the box when a preselected pressure is attained in said fluid-operated control circuitry. The boxes are not damaged by the weight of the sealing head insisting thereon during progress of the sealing operation proper, and exceedingly long up and down strokes of the sealing head are avoided when comparatively tall boxes are to be sealed.

3 Claims, 5 Drawing Figures

MACHINE FOR SEALING PARALLELEPIPEDAL BOXES HAVING A VARIABLE HEIGHT

This invention relates to a machine for sealing with an adhesive tape the upper wall of parallelepidal boxes having a variable height.

In the Italian Patent Specification No. 946,715 in the name of the same Applicant hereof, a machine is disclosed, which is adapted to the use aforementioned, such a machine comprising a rest plane for the boxes, conveyor means to have the boxes advancing along said rest plane, a tape-applying head which is vertically displaceable above said rest plane and is urged by its own weight towards a position of maximum depression, lifting means for lifting said tape-applying head from said maximum depression position and sensitive means as carried by said tape-applying head in correspondence with its inlet end and capable of being engaged by the front wall of each box to command the instantaneous actuation of said lifting means up to a distance of the tape-applying head from the rest plane which is higher than the height of the box (whereafter the tape-applying head will drop by the gravity pull onto the box which has meanwhile been fed farther forward, engaging the top wall thereof to apply thereto a sealing tape of the adhesive type in correspondence with the line of separation between two top flaps folded down in the closed position).

Along with its indisputable valuable properties (especially the adaptability to a number of different box heights) that the machine disclosed in the aforementioned patent is capable of affording, there is in such machine the problem which is represented by the weight with which the tape-applying head insists upon the box during progress of the tape-application stage. It is apparent, therefore, that not too sturdy boxes can be damaged under the heavy load of a tape-applying head, which, for obvious reasons, cannot have a too little minimum weight.

An object of the present invention is exactly that of solving the problem outlined hereinabove, by such an arrangement that, while keeping the principle of exploiting the gravity pull (for dropping the tape-applying head onto the box after its instantaneous lifting) unaltered, the tape-applying head does no longer insist with its entire weight on the underlying box.

Having this object in view, the machine according to the present invention, which, similarly to what had been disclosed in the the abovementioned Italian Patent Specification No. 946,715, comprises a rest plane for the boxes, conveyor means for having the boxes fed foward along said rest plane, a tape-applying head vertically displaceable above said rest plane and thrust by its own weight towards a position of maximum depression, lifting means to lift said tape-applying head from that position of maximum depression and sensitive means borne by said tape-applying head in correspondence of the inlet end thereof and engageable by the front wall of every box to command the instantaneous actuation of the lifting means aforesaid up to a distance of the tape-applying head from said rest plane which is higher that the height of the box, said lifting means comprising at least a hydraulic and/or pneumatic ram and a valve controlled by said sensitive means so as alternately to connect to a pressurized fluid source, or to an outlet, a control chamber of said hydraulic or pneumatic ram, said machine being characterized in that between the control chamber of the hydraulic or pneumatic ram and the valve controlled thereby, a cutoff valve is inserted, which is capable automatically to shut the communication between the controlled valve and the ram whenever the pressure within said chamber of the ram drops below a preselected magnitude.

The importance of the cutoff valve provided by this invention in the fluid-pressure system of command of the lifting of the tape-applying head can readily be understood if it is considered that during the dropping stage of the tape-applying head towards the conditions of engagement with the box top wall, the command chamber of the fluid-pressure ram intended to lift the tape-applying head the valve as controlled by the sensitive means is connected to the outlet but in the valve interior a residual pressure still obtains, which is produced by the fluid-dumping thrust due to the weight with which the tape-applying head insists on the plunger sliding in the ram interior. Such a pressure could initially be above the preselected limiting value which caused the cutoff valve switching, but, at the instant when the tape-applying head abuts the box top wall, the drop of the tape-applying head is stopped and the thrust on the plunger is discontinued, so that the pressure in the control chamber of the fluid-operated ram suddenly drops below the preselected magnitude aforesaid. At such a stage the cutoff valve cuts any communication between the ram and the outlet so that the control chamber of the ram retains a fluid pressure which nearly equals the preselected pressure which brings about the switching of the cutoff valve. Such pressure, which can appropriately be varied by properly calibrating the discharge pressure of the cutoff valve, efficiently biases the gravity pull of the tape-applying head, thus preventing same from insisting with its entire weight on the underlying box. Any possible damage to the box is thus prevented.

Features and advantages of the present invention will become more fully apparent from the ensuing detailed description of a preferred embodiment thereof as shown in the accompanying drawings by way of example only.

Figure 1:
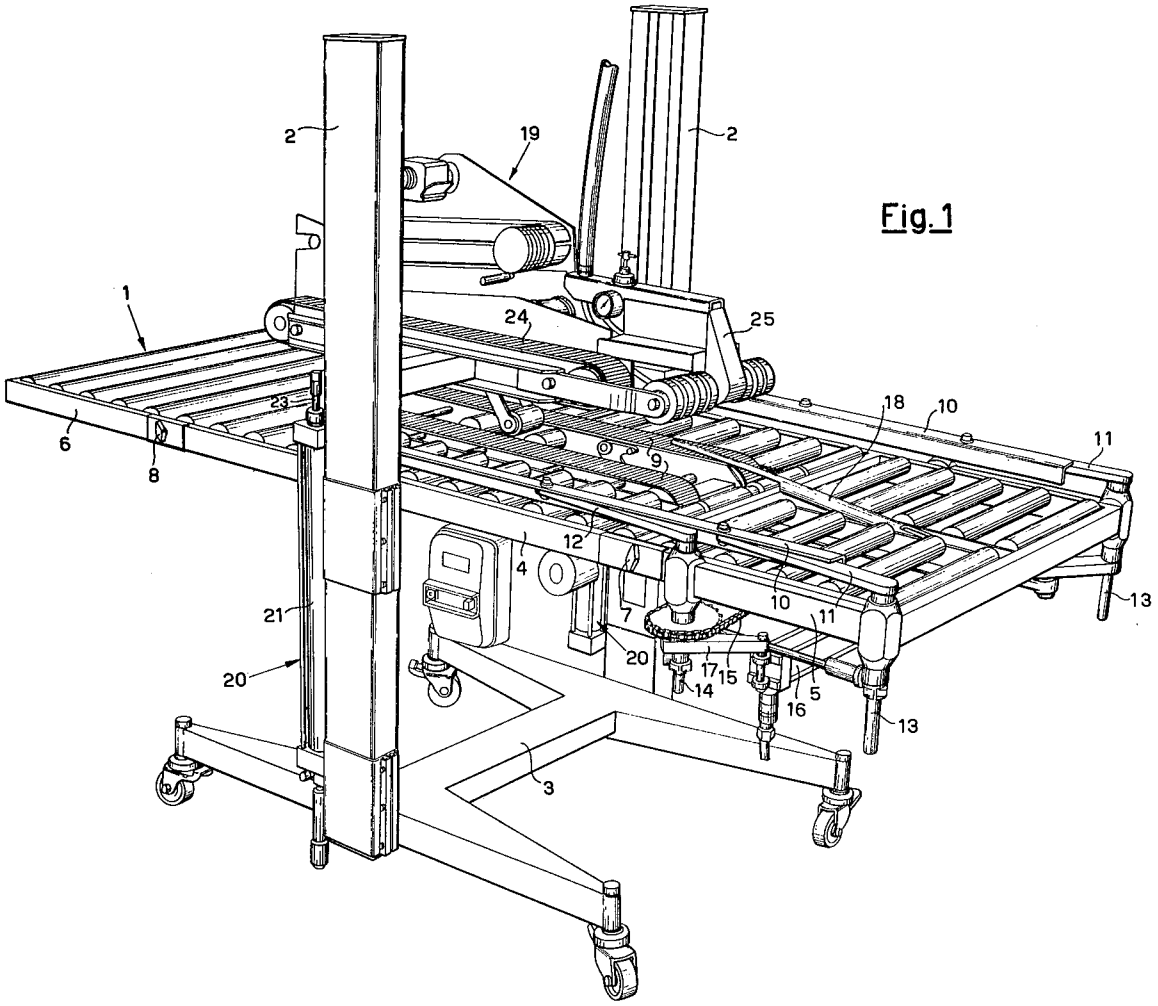
FIG. 1 is a perspective view of a machine according to the present invention in the rest position.

The machine shown in the drawings, and more particularly in FIG. 1 thereof, comprises a roller conveyor path 1, which is fastened, in its middle portion, to two supporting uprights 2 which rest on a wheeled pedestal 3. For convenience of transportation, the roller path 1 is split into three portions, a middle portion 4 and two side portions 5 and 6, the latter two being collapsible downwards by being swung about pins 7 and 8, so as to minimize bulk.

The roller path 1 is the rest plane for the boxes to be sealed, the latter being loaded onto the inlet portion 5 of the roller pathway in a condition of complete closure (that is with the top flaps properly folded down horizontally and confrontingly), to be caused to advance along the entire roller pathway by a couple of conveyor belts 9: these are arranged on the middle portion of the roller pathway and driven by a prime mover which is not shown in the drawings. The inlet portion 5 and the initial portion of the middle section 4 of the roller pathway 1 are laterally confined by two guides 10. Such guides are linkably connected, by rods 11 and 12, to idle arbors 13 and to control arbors 14, respectively, which are drivably connected by a chain 15 and can be rotatably servoed by a pneumatic ram 16 by the agency of a crank 17 keyed by either arbor 14 (FIG. 1). The two guides 10 are normally in the outspan rest position of FIG. 1 and can be displaced towards the approached working position of FIGS. 2–4 by actuating the ram 16, which is controlled by a lever 18 inserted in the path of advance of the boxes and can be engaged by the bottom wall of any box.

Over the middle portion 4 of the roller pathway 1 a tape-applying head 19 is arranged, which is vertically supported for sliding by the two side uprights 2. The tape-applying head 19 is urged by its own weight towards a deepest depressional position as shown in FIG. 1 and can be temporarily lifted relative to said position by simultaneously actuating two pneumatic rams 20 having the ram member 21 fastened to a respective upright 2 and the plunger member 22 with its stem 23 fastened to the tape-applying head 19.

Figure 2:
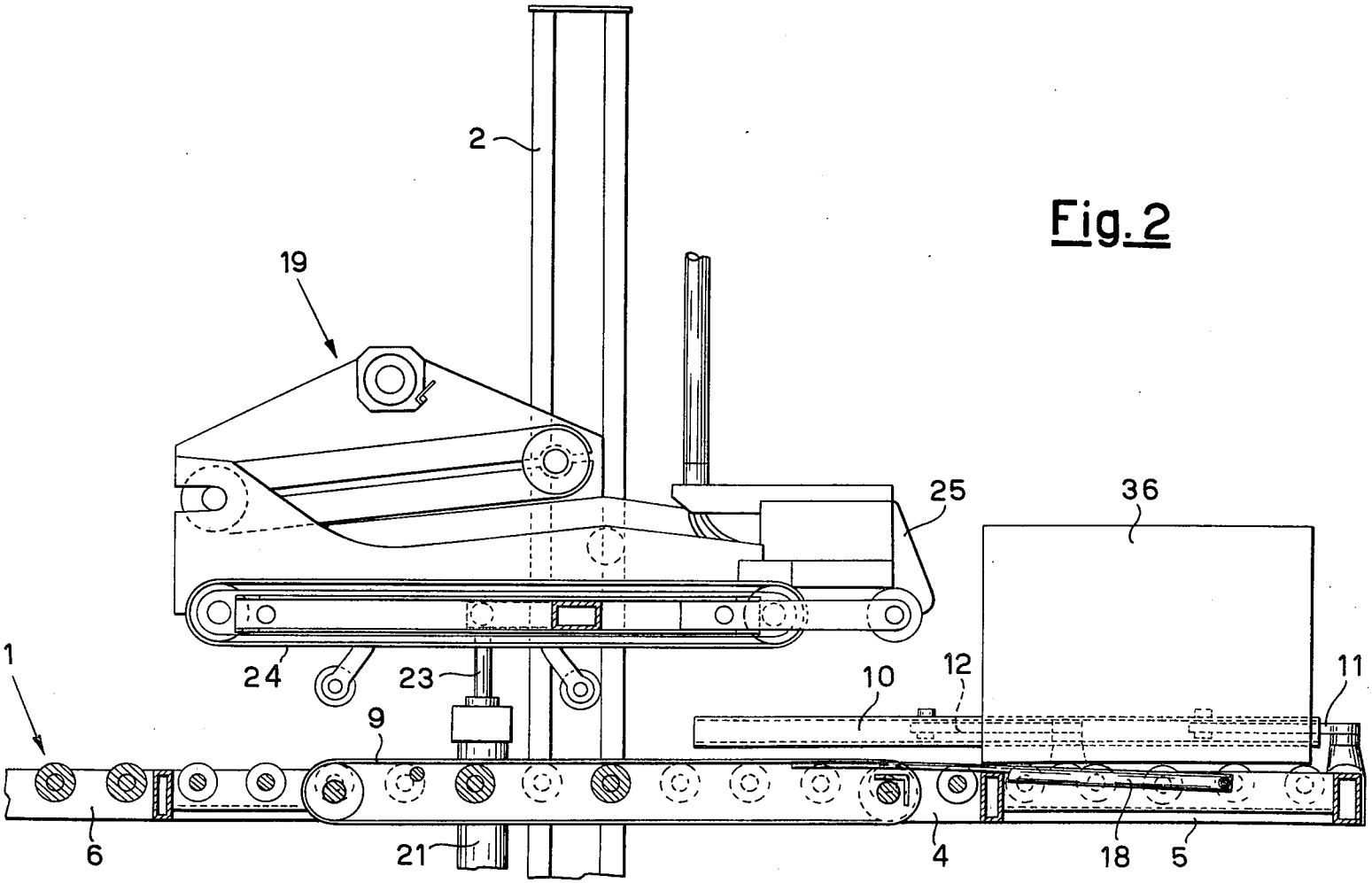
FIGS. 2, 3 and 4 are illustration, in front elevational view, of as many working stages of the machine shown in FIG. 1.

In addition to the usual tape-applying component parts which are not described in detail herein as they are conventionally known, the tape-applying head 19 carries a couple of conveyor belts, 24, which are adapted to coact with the underlying conveyor belts 9, and with the box to be sealed inserted therebetween to effect the feed forward of the boxes to be sealed; a lever 25 arranged in correspondence with the tape-applying head 19 inlet end can be both engaged and depressed by the front wall of the boxes as these are being fed forward (FIG. 2).

Figure 5:
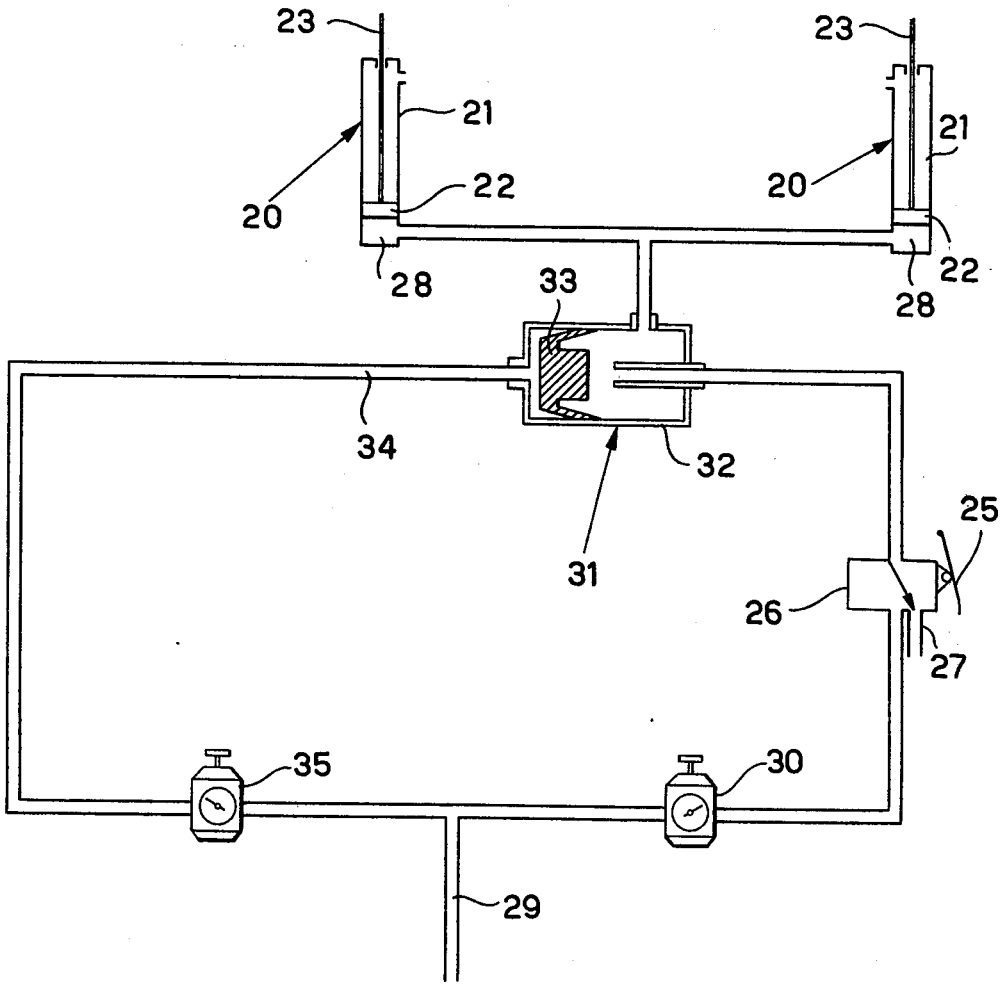
FIG. 5 shows the operative diagram of the fluid-operated system for lifting the tape-applying head in the machine of FIG. 1.

As can be seen in FIG. 5, the lever 25 is active upon a pneumatic valve 26, which, when the lever 25 is in the rest position, connects to an outlet 27 the lower control chambers 28 of the two rams 20 and, when the lever 25 is pressed, connects the same chambers 28 to a source of compressed air 29 via a pressure-reduction device 30 which can be calibrated. Between the rams 20 and the valve 26 a cutoff valve 31 is inserted: the latter is composed by an outer cylinder 32 and a plunger 33 fitted with a rubber cup gasket. The position of closure or opening of the plunger is determined by the air pressure which acts on the two opposite surfaces of the gasket. As viewed in FIG. 5, on the right surface the pressure is active which obtains within the control chambers 28 of the cylinders 20, whereas on the left surface a pressure is active which has a preselected value, as obtaining in a duct 34 connected to the compressed air feed duct 29 via an adjustable pressure-reducing device 35.

The machine as described above operates as follows: Every box 36, which rests from time to time on the inlet section 5 of the roller pathway 1 and is fed thereon, manually at the outset, towards the outlet section 6, bumps into the lever 18 and, by depressing same, acts in such a way that the pneumatic ram 16 controls the mutual approaching of the two guides 10 (FIG. 2). The box 36 is thus properly centered and can go forward under these conditions while having its sidewalls engaged by the guides 10.

Figure 3:
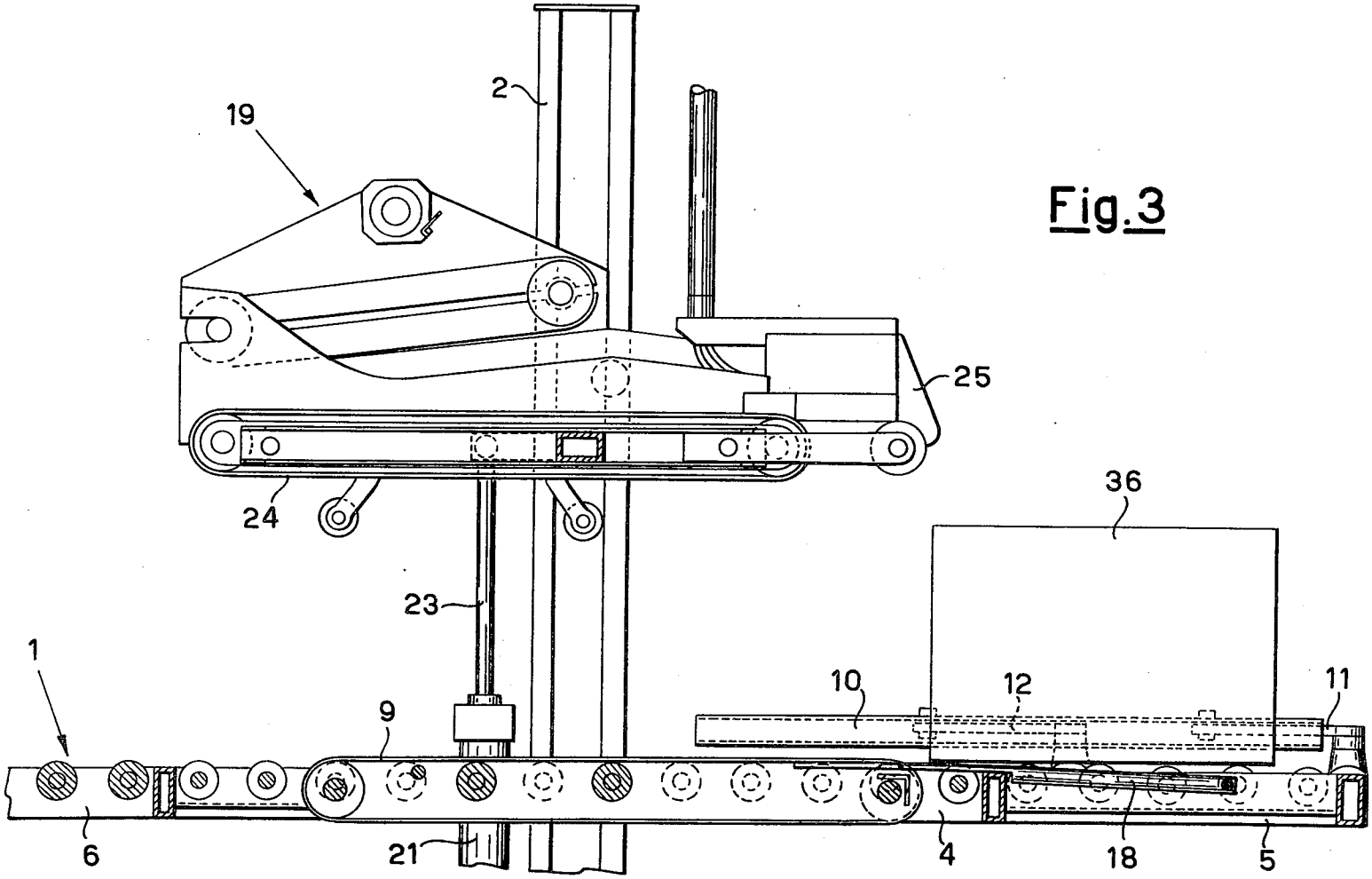

As soon as the front wall of a box meets the lever 25 and depresses it, the valve 26 establishes a communication between the compressed air source 29 and the lower control chambers of the two pneumatic rams 20 (FIG. 5), so that the plungers 22 of the latter rams are lifted and thus lift, in turn, the tape-applying head until a complete disengagement is achieved of the box 36 from the lever 25, that is to say up to a distance from the roller pathway 1 which is higher, though only slightly, than the height of the box to be sealed, (FIG. 3). At this stage, providing that the pressure-reducing device 35 has been properly calibrated, such pressures are active upon the two surfaces of the plunger 33 of the cutoff valve 31, as to urge the plunger 33 towards the open position of the communication between the rams 20 and the valve 26 (FIG. 5).

Figure 4:
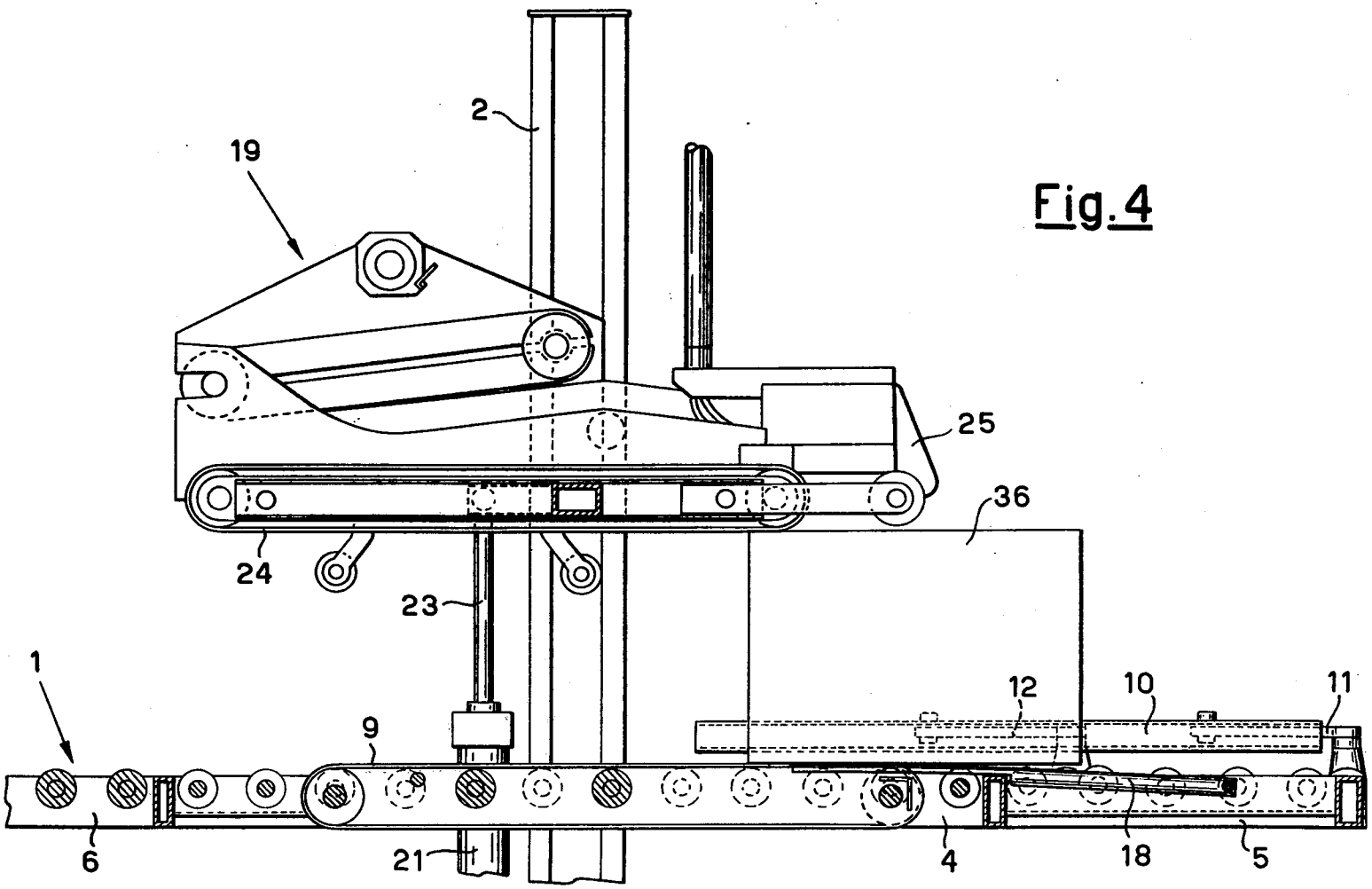

As soon as the lever 25 is clear of the box 36 (FIG. 3), the valve 26 re-establishes the communication between the chambers 28 of the rams 20 and the outlet 27, so that the tape-applying head 19 is urged downwards again by its own weight and goes to abut the box 36 top wall, the box having meanwhile been engaged by the conveyor belts 9 and 24 and thrust forward thereby (FIG. 4).

As the tape-applying head is dropped again, there is still in the chambers 28 of the rams 20, even though connected to the outlet, a residual positive pressure due to the thrust impressed by the plungers 22 on which the weight of the tape-applying head insists. When, however, the tape-applying head rests on the top wall of the box 36, the plungers 22 are stopped, so that the pressure in the chambers 28 abruptly drops down to a value which is just slightly below the preselected pressure obtaining in the duct 34. At this stage, the plunger 33 fitted with the rubber cup is shifted towards the right (as viewed in FIG. 5) and stops the communication between the chambers 28 and the valve 26 and thus also the outlet 27. Thus, in the chambers 28 and air pressure is occluded, which is substantially equal to the preselected value as provided by the pressure-device 35 (since the special shape of the plunger 33 permits, inter alia, a limited air seeping from the left to the right) and such pressure biases the weight of the tape-applying head 19 so as to limit the force with which the head insists on the top wall of the box 36, any damage thereto being consequently prevented. It should be noted that the back-pressure left within the chambers 28 and thus the force impressed by the tape-applying head 19 to the underlying box can easily be adjusted as a function of the sturdiness of a box by properly adjusting the pressure-reducing device 35.

Once the correct contact relationship is achieved between the sealing head 19 and the box 36 (FIG. 4), the conveyor belts 9 and 24 feed the box continually forward and the sealing head 19 applies an adhesive sealing tape in correspondence with the line of contact between the two box top flaps as folded down in closure position. Obviously, as the box 36 is clear of the lever 18, the guides 10 are spaced wide apart and, likewise, as the box 36 is clear of the sealing head 19, the latter is reverted to its deepest position of FIG. 1: the plunger 33 of the cutoff valve 31, in its turn, is restored to its rest position of FIG. 5. If so desired, the deepest position of the sealing head 19 can be made adjustable, either mechanically, or by inserting a closing valve in the outlet duct 27, such valve being engaged at the instant of time when it reaches, when dropped again, a predetermined position which can thus be adjusted. This expedient permits to dispense with exceedingly long up and down strokes when the boxes are comparatively tall.

What I claim is:

1. A machine for sealing parallelpipedal boxes of different heights comprising a rest plane for the boxes, conveyor means to advance the boxes along said rest plane from an inlet section of said conveyor means, a tape-applying head mounted for vertical displacement above said rest plane and for thrust by its own weight toward a position of maximum depression, lifting means to lift said tape-applying head from the position of maximum depression, sensitive means carried by said tape-applying head and engageable by a front wall of each of the boxes coming from said inlet section of said conveyor means to control the instanteous actuation of said lifting means to vertically displace said tape-applying head to a distance above said rest plane which is higher than the height of the box engaging said sensitive means, said lifting means including at least one fluid-operated ram having a control chamber, valve means controlled by said sensitive means to connect alternately to a pressurized fluid source and to an outlet, a cutoff valve inserted between said control chamber of said fluid-operated ram and said controlled valve means, said cutoff valve automatically cutting communication between said controlled valve means and said control chamber of said ram whereas the pressure within said control chamber of said ram drops below a preselected magnitude.

2. The machine in accordance with claim 1, further characterized by said cutoff valve including a plunger fitted with a rubber cup gasket which slides within a cylinder between an open position and a closed position for controlling communication between said control chamber of said fluid-operated ram and said controlled valve means, a surface of said plunger being subjected to the fluid pressure existing in said control chamber, the opposite surface of said plunger subjected to a fluid pressure of a preselected magnitude.

3. The machine in accordance with claim 2, further characterized by an adjustable pressure-reducing device supplying said pressure of a preselected magnitude to said opposite surface of said plunger.

* * * * *